US007686089B2

(12) United States Patent
Howlett et al.

(10) Patent No.: US 7,686,089 B2
(45) Date of Patent: Mar. 30, 2010

(54) HANGING APPARATUS AND METHOD

(75) Inventors: Paul Howlett, Aberdeen (GB); Michael Wardley, Laurencekirk (GB); Graeme Marr, Inverurie (GB)

(73) Assignee: Caledus Limited, Aberdeen (GB)

( * ) Notice: Subject to any disclaimer, the term of this patent is extended or adjusted under 35 U.S.C. 154(b) by 0 days.

(21) Appl. No.: 11/664,673

(22) PCT Filed: Oct. 10, 2005

(86) PCT No.: PCT/GB2005/003886

§ 371 (c)(1),
(2), (4) Date: Apr. 4, 2007

(87) PCT Pub. No.: WO2006/038033

PCT Pub. Date: Apr. 13, 2006

(65) Prior Publication Data

US 2008/0110641 A1 May 15, 2008

(30) Foreign Application Priority Data

Oct. 8, 2004 (GB) ..... 0422329.3

(51) Int. Cl.
*E21B 23/00* (2006.01)
*E21B 43/10* (2006.01)

(52) U.S. Cl. ..... 166/382; 166/208; 166/207; 166/206

(58) Field of Classification Search ..... 166/382, 166/384, 208, 206, 207, 380; 72/370.01, 72/370.08, 393, 370.06
See application file for complete search history.

(56) References Cited

U.S. PATENT DOCUMENTS

| | | | | |
|---|---|---|---|---|
| 3,367,002 | A | 2/1968 | Johnson | |
| 3,877,282 | A * | 4/1975 | Pogonowski | 72/393 |
| 4,793,411 | A * | 12/1988 | Zunkel | 166/98 |
| 5,131,468 | A * | 7/1992 | Lane et al. | 166/120 |
| 6,223,823 | B1 | 5/2001 | Head | |
| 6,648,075 | B2 * | 11/2003 | Badrak et al. | 166/381 |
| 2002/0175474 | A1 * | 11/2002 | Simpson et al. | 277/314 |
| 2003/0037931 | A1 | 2/2003 | Coon | |
| 2003/0042022 | A1 * | 3/2003 | Lauritzen et al. | 166/277 |
| 2003/0042028 | A1 * | 3/2003 | Lauritzen et al. | 166/384 |
| 2003/0075337 | A1 * | 4/2003 | Maguire | 166/380 |
| 2003/0205386 | A1 * | 11/2003 | Johnston et al. | 166/382 |
| 2004/0099423 | A1 * | 5/2004 | Badrak et al. | 166/380 |

FOREIGN PATENT DOCUMENTS

| | | |
|---|---|---|
| WO | WO 02/38343 A2 | 5/2002 |
| WO | WO 03/093639 A1 | 11/2003 |

* cited by examiner

*Primary Examiner*—Jennifer H Gay
*Assistant Examiner*—Cathleen R Hutchins
(74) *Attorney, Agent, or Firm*—Sughrue Mion, PLLC

(57) ABSTRACT

Apparatus, such as a liner, adapted to be hung in a downhole tubular such as casing is described. The apparatus includes one or more circumferentially distributed abrasive portions, arranged to be movable radially outwards by a dimple former or an expander. In an embodiment, the abrasive portions are provided on disks moveable in recesses in the outer diameter of the apparatus being hung. In an embodiment, the apparatus is hung by operating a dimple former provided on the running tool.

29 Claims, 6 Drawing Sheets

HANGING APPARATUS AND METHOD

BACKGROUND OF THE INVENTION

The present invention relates to an apparatus and a method for hanging apparatus on the inner diameter of a downhole tubular, such as an existing casing string in a wellbore. In one of its aspects, the invention relates to an improved liner and a method of hanging a liner from an existing casing section or other tubular in a wellbore.

In the field of wellbore operations, liners are strings of pipe, used to case open holes below an existing casing. It is known to use liner hangers to anchor a liner to the inner diameter of an existing casing string. A number of techniques have been employed to meet these aims.

It is often necessary to anchor apparatus and tools other than liners in downhole tubulars, for example to cover up holes in casing. Examples include the hanging or anchoring of packers, plugs, bridge plugs, sandscreens, scab liners or other apparatus.

Generally, existing hanging methods are unsuitable for tight tolerance or close clearance casing schemes. The tolerance of standard casing is not tight enough to allow for substantial surface variations on a tubular or tool being hung, such as surface irregularities, without risk of the tubular or tool jamming within the casing.

PCT Application Number PCT/GB03/01895 describes a method and apparatus for expanding tubulars. This involves radially expanding a first smaller diameter tubular into frictional contact with a second larger diameter tubular or well bore. The disadvantage of this method is that an expanding helical band, such as therein described, is weakened as it is expanded and will part if put under too much pressure. Additionally radial deformation of the first tubular will lead to a decrease in the tensile strength of the first tubular.

U.S. Pat. No. 6,223,823 describes a method of installing a casing section in a well, where in one aspect a technique known in the art as dimpling is used. Here, discrete sections of the liner profile are forced to expand into corresponding eccentric undercuts of the existing casing in order to fix the casing being installed in the required position. This is achieved by means of forcing a number of pellets or dimple formers radially outwards into the liner.

A disadvantage of this technique is that dimpling alone is insufficient to sustain a high hanging load and slippage often occurs. Furthermore this technique requires an eccentric undercut being formed on the existing casing. This is another distinct disadvantage as it is difficult to make such undercuts inside a casing when already in place. Therefore, such formations must be carried out well in advance, or a compatible casing must have been installed when the bore was cased.

It is an object of at least one embodiment of the present invention to provide apparatus for anchoring to an existing casing string that obviates and mitigates one or more disadvantages and limitations of the prior art.

Moreover, it is an object of at least one embodiment of the present invention to provide a means for hanging apparatus in an existing casing string that is integral to the wall thickness of the apparatus.

It is a further aim and object of at least one embodiment of the invention to provide a method and apparatus for suspending, anchoring or hanging apparatus from the inner diameter of an existing downhole tubular in a wellbore which obviates or mitigates the disadvantages and drawbacks associated with the prior art.

SUMMARY OF THE INVENTION

According to a first aspect of the invention, there is provided apparatus adapted to be hung in a downhole tubular, the apparatus comprising a tubular member having an outer surface and an inner surface wherein the outer surface includes one or more circumferentially distributed abrasive portions, the said one or more abrasive portions being arranged to be movable radially outwards and with respect to the outer surface of the tubular member, to bring said abrasive portions into frictional contact with a downhole tubular.

In the context of this specification, the term "one or more circumferentially distributed abrasive portions" means either a single abrasive portion extending fully or partially in a circumferential direction, or a plurality of discrete abrasive portions separated circumferentially. The one or more abrasive portions may also have a degree of axial separation and/or distribution.

By increasing friction between the apparatus and the downhole tubular, this will improve the possible hanging load over that achievable by dimpling alone.

Preferably the one or more abrasive portions are disks on the outer surface of the tubular member, each comprising an abrasive surface.

Optionally the one or more abrasive portions are located in one or more recesses on the outer surface of the apparatus. Preferably the one or more recesses are machined.

Most preferably the recesses are sized that the disks are flush with the outer diameter of the tubular member. Optionally the recesses are sized that the disks are beneath the outer diameter of the tubular member.

Having the disks flush or beneath the outer diameter of the tubular member ensures that the risk of snagging between the abrasive surfaces and the downhole tubular or casing is minimised.

Most preferably the material of the one or more abrasive portions is harder than the material of the tubular member.

Optionally each abrasive surface comprises one or more formations extending from the surface of the disk to a first height, and one or more formations extending from the surface of the disk to a second height, greater than the first height.

Preferably, the one or more formations extending to the second height provides a pivot about which the disk is able to tilt on application of a force in an axial direction of the tubular member. More preferably, the one or more formations extending to the first height are shaped to provide an opposing force in an axial direction of the tubular member.

The formations extending to the first height may thereby be shaped to provide bite in an upward or lower direction. The design of the disk is bi-directional in that it provides forces opposing compressive or tensile forces applied to one or other of the tubulars.

Optionally each abrasive surface is a machined surface of the disk.

Most preferably each abrasive surface is a sequence of ridges.

Alternatively each abrasive surface is a plurality of teeth.

In a further alternative, each abrasive surface is knurled. Optionally the knurled surface is hardened.

Preferably when one abrasive portion is provided it is a single circumferential band around the liner. Advantageously a plurality of portions is provided, distributed equidistantly around the liner. This allows an abrasive portion to be provided for each dimple of the dimple former.

In a further alternative, each abrasive surface comprises one or more abrasive inserts.

Preferably the one or more inserts are made of hard steel.

Preferably the one or more recesses have a base which is spherical in relief, in order to spread the load into the one or more abrasive portions evenly.

Optionally, the apparatus is adapted to be hung in the tubular member using one or more dimple formers, and the one or more abrasive portions are arranged to be movable radially outwards by the dimple formers.

Optionally, the apparatus is adapted to be hung in the downhole tubular using one or more expanders, and the one or more abrasive portions are arranged to be movable radially outwards by employing the one or more expanders.

Preferably, the apparatus is a liner. More preferably, the downhole tubular is casing.

According to a second aspect of the invention there is provided a liner for hanging in a casing using one or more expanders, the liner comprising a tubular member with a hollow bore therethrough, having an outer surface and an inner surface wherein the outer surface includes one or more circumferentially distributed abrasive portions, wherein the said one or more abrasive portions are arranged to be movable radially outwards and with respect to the outer surface of the tubular member by employing the one or more expanders to bring said abrasive portions into frictional contact with the casing into which the liner has been inserted.

Optionally the liner further comprises a sealing means to form a seal between the liner and the casing when the one or more expanders are employed.

Optionally the sealing means comprises a rubberised coating on the outer surface of the liner. Advantageously the rubberised coating is distinct from the abrasive portions.

In this way, when the liner is expanded the abrasive portions come into frictional contact with the casing to support the load of the hanging liner. Furthermore, the rubberised coating is trapped between the liner and the casing forming a seal.

According to a third aspect of the invention, there is provided a liner, for hanging in a casing using one or more dimple formers, the liner comprising a tubular member with a hollow bore therethrough, having an outer surface and an inner surface wherein the outer surface includes one or more circumferentially distributed abrasive portions, wherein the said one or more abrasive portions are arranged to be movable radially outwards by the dimple formers to bring said abrasive portions into frictional contact with the casing into which the liner has been inserted.

Preferably, the abrasive portions are adapted to be moveable with respect to the outer surface of tubular member.

According to a fourth aspect of the invention, there is provided a method of hanging apparatus in a downhole tubular, the method comprising the steps of:

(a) Running the apparatus into the downhole tubular, the apparatus comprising a tubular member having an outer surface and an inner surface, wherein the outer surface comprises one or more circumferentially distributed abrasive portions;

(b) Upon reaching a desired position in the tubular, locating one or more dimple formers on the inner surface of the tubular member corresponding to the locations of the one or more abrasive portions on the outer surface; and (c) Moving the abrasive portions radially outwards by moving the dimple formers to contact on the inner surface of the tubular member, such that the abrasive portions are moved into frictional adherence with the downhole tubular.

Preferably, the method includes the step of moving the abrasive portions with respect to the tubular member.

Optionally, the method comprises the additional step of selecting the tubular member to have an outer diameter such as to form an interference fit with the downhole tubular.

Optionally the method comprises the step of selecting dimple formers which are located on a running tool which runs the tubular member into the downhole tubular. Alternatively the method comprises the step of selecting dimple formers which are features of a separate downhole tool run into the tubular member once it is already positioned within the downhole tubular.

In this way, the apparatus can be located and hung within the tubular in a single running operation, or can be located within the downhole tubular in one running operation then hung within the downhole tubular in a further running operation.

Preferably and advantageously, the method comprises the additional step of moving the abrasive inserts by the distance required to impress the abrasive portions into frictional adherence with the downhole tubular.

Preferably the method comprises the step of selecting a material for the one or more abrasive portions that is harder than the material of the downhole tubular.

The depth of impression required will vary depending on the tubular, the material of the apparatus, and the material and design of the abrasive inserts.

Most preferably the method comprises the step of selecting a downhole tubular that has an inner diameter machined or manufactured to a high tolerance.

Preferably the method comprises the step of selecting a liner that is machined or manufactured to form a close clearance fit within the downhole tubular.

A high tolerance inner diameter ensures that the close fitting liner is able to form as close a fit as possible while preventing the possibility of the apparatus, such as a liner, jamming within the downhole tubular. The tolerance of standard tubulars is not tight enough to ensure that the one or more abrasive portions would reach the inner diameter of the downhole tubular without the apparatus being too big to fit in the tubular.

Optionally the method comprises the step of hanging the apparatus in casing. Alternatively, the method comprises the step of hanging the apparatus in a pipe or a dedicated joint which has been deployed within a previously set tubular.

According to a fifth aspect of the invention there is provided a method of hanging apparatus in a downhole tubular, the method comprising the steps of:

(a) Running the apparatus into the downhole tubular, the apparatus comprising a tubular member having an outer surface and an inner surface, wherein the outer surface comprises one or more circumferentially distributed abrasive portions;

(b) Upon reaching a desired position in the downhole tubular, locating one or more expanders on the inner surface of the tubular member corresponding to the locations of the one or more abrasive portions on the outer surface; and (c) Moving the abrasive portions radially outwards and with respect to the outer surface of the tubular member by moving the one or more expanders to contact on the inner surface of the tubular member, such that the abrasive portions are moved into frictional adherence with the downhole tubular.

Preferably the method comprises the preliminary step of coating the outer surface of the apparatus with a rubberised coating. Advantageously the method further comprises the step of ensuring that the rubberised coating is distinct from the abrasive portions.

Most preferably and advantageously the method comprises the step of selecting the one or more expanders to comprise at least two distinct diameters, one of which is larger than the inner diameter of the tubular member and another of which is smaller than the inner diameter of the tubular member.

Preferably the method comprises the step of selecting the one or more expanders to be shaped as cones. Optionally the method comprises the step of selecting the one or more expanders to be shaped as conical frustums.

Preferably the method comprises the additional step of running the expander through the apparatus from bottom to top. Alternatively the method comprises the additional step of running the expander through the apparatus from top to bottom.

As the expander moves along the inner diameter of the tubular member, the tubular member is expanded by virtue of the larger diameter of the expander. The abrasive portions thus come into frictional contact with the downnhole tubular or casing.

Most preferably and advantageously the method comprises the step of locating the expander within the apparatus below the abrasive portions, the smaller diameter of the expander topmost, such that the expander can be run upwards through the apparatus.

The upwards motion of the expander expands the tubular member, and in the locations where the tubular member overlaps the downhole tubular the apparatus is brought into contact with the casing. The abrasive portions thus come into frictional contact with the tubular to allow the apparatus to hang.

Preferably the method comprises the step of selecting the abrasive portions to be disks located within recesses on the outer diameter of the liner, the disks being radially movable within the recess and each disk comprising an abrasive surface.

According to a sixth aspect of the present invention, there is provided a liner for hanging in a casing using one or more expanders, the liner comprising a tubular member with a hollow bore there through, having an outer surface and an inner surface wherein the outer surface includes one or more circumferentially distributed abrasive portions, wherein the said one or more abrasive portions are arranged to be movable radially outwards by employing the one or more expanders to bring said abrasive portions into frictional contact with the casing into which the liner has been inserted.

According to a seventh aspect of the present invention, there is provided a method of hanging a liner in a tubular, comprising the steps of:

(a) Running the liner into the tubular, the liner comprising a tubular member with a hollow bore there through, having an outer surface and an inner surface, wherein the outer surface comprises one or more circumferentially distributed abrasive portions;

(b) Upon reaching a desired position in the tubular, locating one or more dimple formers on the inner surface of the liner corresponding to the locations of the one or more abrasive portions on the outer surface; and (c) Moving the abrasive portions radially outwards by moving the dimple formers to contact on the inner surface of the liner, such that the abrasive portions are moved into frictional adherence with the tubular.

According to an eighth aspect of the present invention there is provided a method of hanging a liner in a tubular, comprising the steps of:

(a) Running the liner into the tubular, the liner comprising a tubular member with a hollow bore there through, having an outer surface and an inner surface, wherein the outer surface comprises one or more circumferentially distributed abrasive portions;

(b) Upon reaching a desired position in the tubular, locating one or more expanders on the inner surface of the liner corresponding to the locations of the one or more abrasive portions on the outer surface; and (c) Moving the abrasive portions radially outwards by moving the one or more expanders to contact on the inner surface of the liner, such that the abrasive portions are moved into frictional adherence with the tubular.

BRIEF DESCRIPTION OF THE DRAWINGS

The present invention will now be described by way of example only and with reference to the accompanying figures in which.

DESCRIPTION OF THE PREFERRED EMBODIMENT

Figure 2:
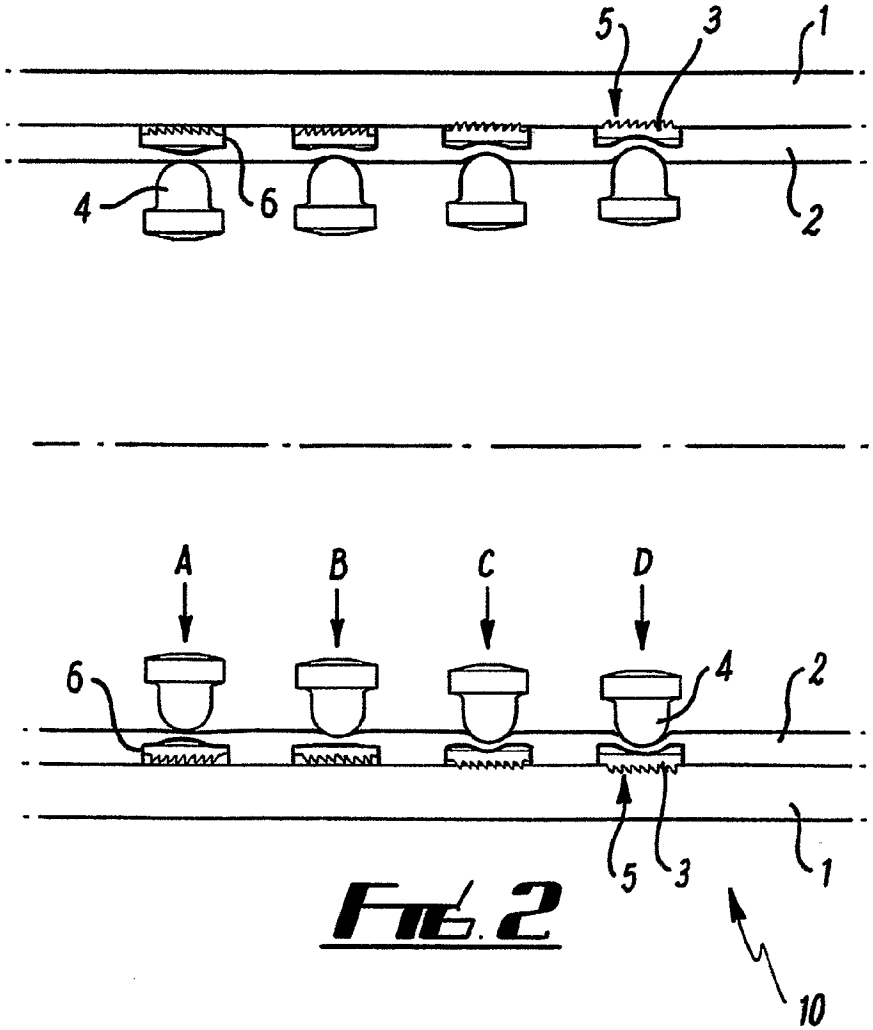
FIG. 2 illustrates in schematic form a lateral cross section of the liner in accordance with the liner of FIG. 1.
Figure 1:
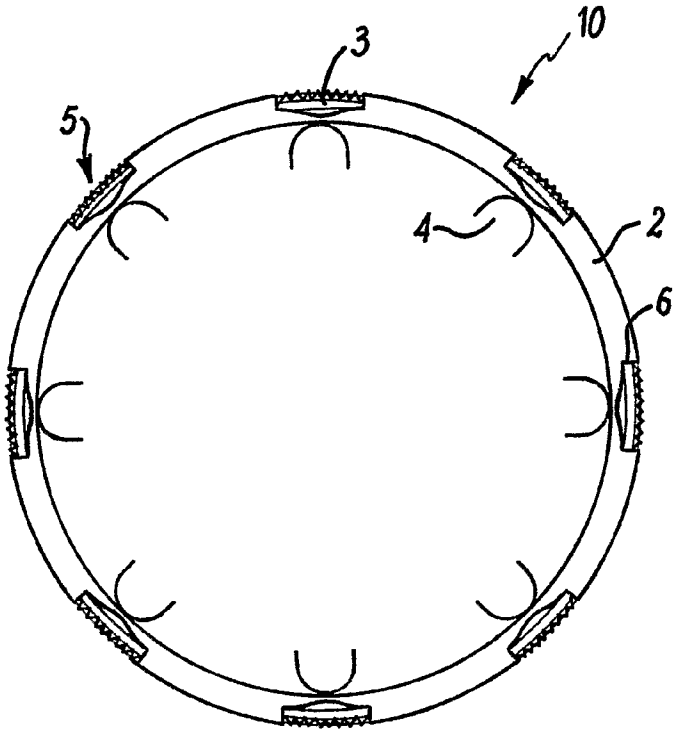
FIG. 1 illustrates in schematic form a longitudinal cross section of the liner in accordance with an aspect of the present invention.
Figure 3:
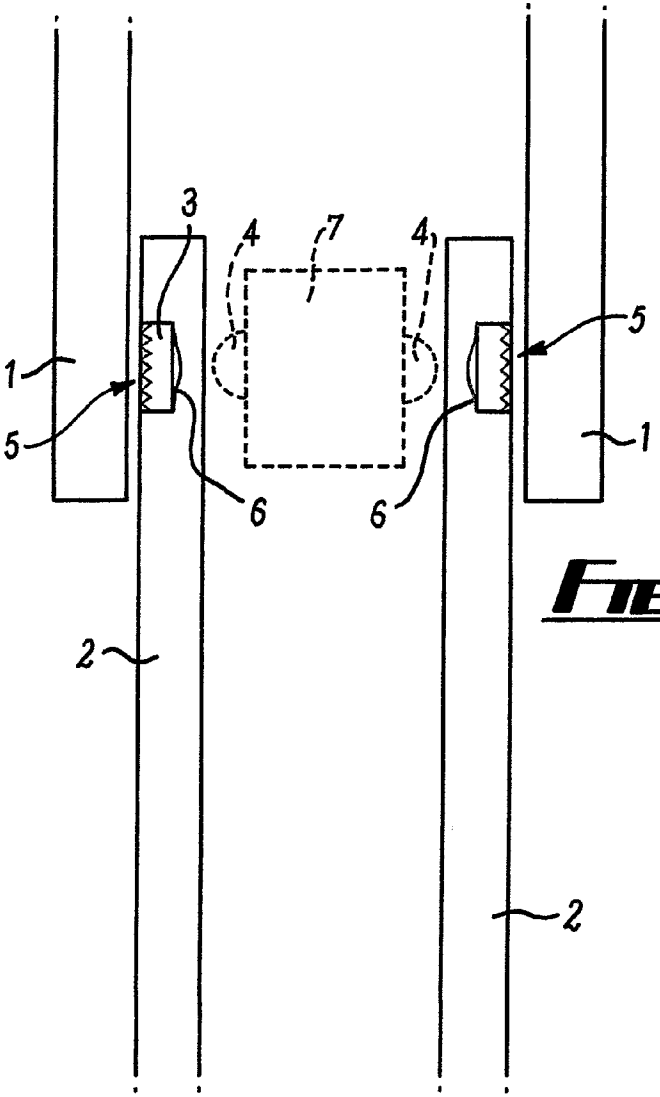
FIG. 3 illustrates in schematic form a longitudinal cross section of the liner in casing in accordance with the liner of FIG. 1.

With reference to FIGS. 1, 2 and 3, there is presented a liner 10 that functions to anchor on existing casing 1 as described in detail below.

The liner 10 comprises a hollow cylindrical body 2, a cross section of which is shown in FIG. 1. In this embodiment, there are eight discrete circular recesses 6 machined into the outer surface of the liner 2. The recesses are located at the upper end of the liner 2, as is indicated in FIG. 3, in the section where the liner 2 overlaps the casing 1. These recesses 6 are equidistantly distributed around the circumference of the outer surface of the liner 2. In this particular embodiment, the depths of the recesses 6 are half the thickness of the liner 2. Additionally the bases of the recesses have a spherical relief. This combination means that the deformation of the liner 2 in the localities of the recesses 6 requires less force than in prior art liners of full thickness, as the liner 2 is considerably thinner at these points.

Additionally, the locations of the recesses 6 are chosen to coincide with the locations of the dimple formers 4 being used, as shown in FIG. 1. It is these dimple formers 4 which provide the radial force required to deform the liner 2 in the localities of the recesses 6.

Inside the eight recesses are located eight circular disks 3. The material of the circular disks 3 is significantly harder than the material of the liner 2 and the casing 1. Each circular disk 3 sits within its respective recess 6 such that the outermost surfaces of the circular disks 3 are flush with the outer surface of the liner 2. On the outermost surface of each circular disk 3 is a series of evenly distributed teeth 5, which are designed to be impressed into a casing 1.

As demonstrated in FIG. 3, the liner 2 is inserted into an existing casing 1, with an overlap which at least covers the section including the dimple formers 4 and circular disks 3. When the liner 2 is at the desired position, the dimple formers 4 are forced radially outwards by some actuation means 7. The liner 2 is then deformed at the localities of the recesses 6 in order to force the circular disks 3 radially outwards to impress the teeth 5 into the inner surface of the casing 1.

With further reference to FIG. 2, an individual dimple former 4 is shown in progressive stages of the hanging procedure. The dimple former 4 is initially at a first position A and at a final position D with intermediate positions B and C, respectively.

Position A shows the dimple former 4 and circular disk 3 configuration before actuation. The dimple former 4 is located radially coincident with the recess 6, to impart as much of the radial force into deforming the liner 2 at this location.

Position B shows the relative position of the dimple former 4 immediately following actuation where slight pressure is now exerted on the inner diameter of the liner 2. The recess 6 has begun to deform, the spherical relief now deformed such that the base of the recess 6 is substantially in contact with the circular disk 3.

Position C shows how the inner diameter of the liner 2 deforms under continued pressure from the dimple former 4 which begins forcing the circular disk 3 outwards towards the existing casing 1. In this position the teeth 5 have started to impress into the casing 1.

Finally position D shows the dimple former 4 at its outermost extreme of travel where the inner diameter of the liner 2 has deformed sufficiently to force the teeth 5 completely into the existing casing 1. The grip of the teeth 5 into the casing 1 ensures that the risk of slippage is minimal. Furthermore, a substantial portion of each of the circular disks 3 are still located within the recesses 6, which holds the liner 2 in place. As the base of the recesses 6 have been deformed and are hence still; in contact with the circular disks 3, there is a solid locating of the liner 2 within the casing 1 which should not slip.

Although eight recesses 6 and eight circular disks 3 have been demonstrated in this embodiment, it will be appreciated that any number of such recesses and disks could be used. In practice, the number and indeed locations of the recesses 6 and circular disks 3 will be chosen to coincide with a particular set of dimple formers 4.

Furthermore, it will be appreciated that the recesses 6 need not be circular. For example, a hexagonal or other cornered shape could be used to locate a similarly shaped disk. This would facilitate inserting disks whose abrasive surfaces are particularly effective in a certain orientation, and thus require to be held in place to preserve this orientation.

In alternative embodiments the disks or formations in the teeth may extend slightly from the surface of liner, to provide a degree of stand-off. Alternatively, or in addition, the recesses may be provided with an extended lip, providing stand-off from the liner outer diameter and a support for the disk as it moves outwardly from the liner.

Figure 4:
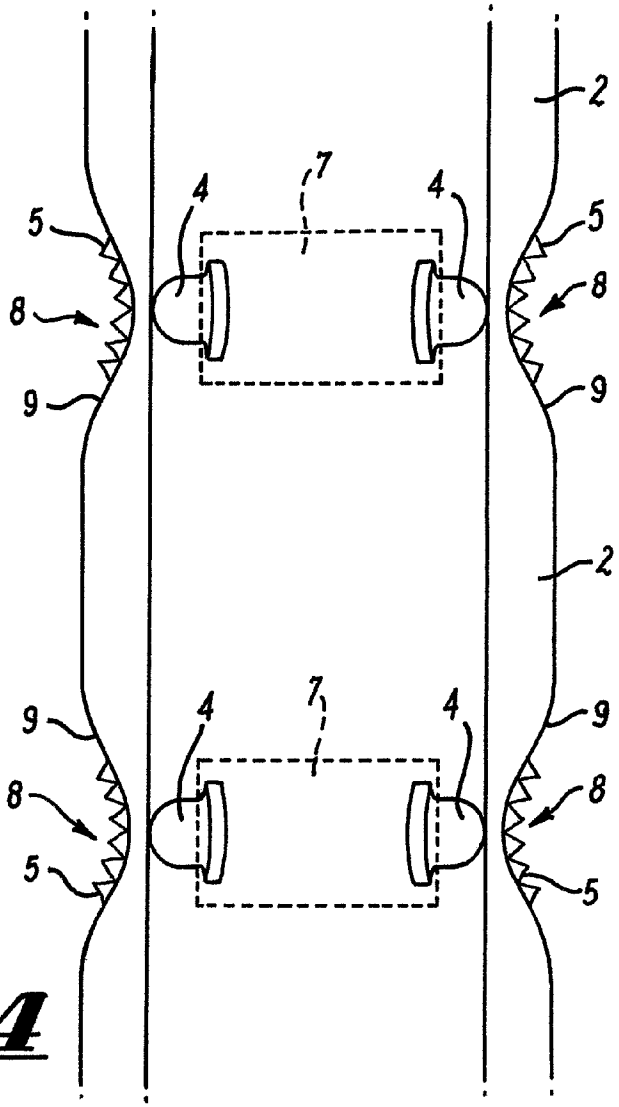
FIG. 4 illustrates in schematic form the liner in accordance with another aspect of the present invention.

FIG. 4 illustrates a liner 2 in accordance with another aspect of the present invention. This liner 2 has two sets of longitudinally separated abrasive portions 8. These sets comprise, in this embodiment, two discrete circumferentially distributed abrasive portions 8, although it will be appreciated that any number of abrasive portions 8 can be chosen.

Each abrasive portion 8 takes the form of a spherical recess 9, machined into the outer surface of the liner 2. The depth of the spherical recess 9 corresponds to more than half of the thickness of the liner 2. However, in practice, the depth of the recess 9 will be chosen to find a suitable compromise between ease of deformation and tensile strength of the liner 2.

On the innermost surface of the spherical recess 9 is located a number of teeth 5, machined into the surface of the liner 2. The dimple formers 4, are again located radially coincident with the recesses 9. The actuation means 7, illustrated here only schematically, will force the dimple formers 4 radially outwards to impact on the inner surface of the liner 2.

As was the case with the previously discussed embodiment, the spherical recesses 9 will deform outwards towards the casing 1 (not shown) such that the teeth 5 will be impressed into the casing 1. As the teeth 5 in this embodiment form part of the liner 2, the liner 2 will thus be affixed to the casing 1.

The spherical recesses 9 provide a thinned section of liner 2 which can be deformed with less force than is required to deform an entire thickness of liner 2. The previous embodiment also offers this advantage, which is expected to reduce the risk of the actuation mechanism 7 from jamming under excessive loads.

Although this embodiment demonstrates discrete spherical recesses in the outer surface of the liner, it will be appreciated that any shape of recess could be used. Furthermore, the recess could extend completely around the circumference of the liner, forming a continuous abrasive portion in the form of a band.

Indeed the location of the abrasive portions 8 and the separation of the sets of abrasive portions 8 will be chosen, in practice, to coincide with a particular set of dimple formers 4.

Figure 5:
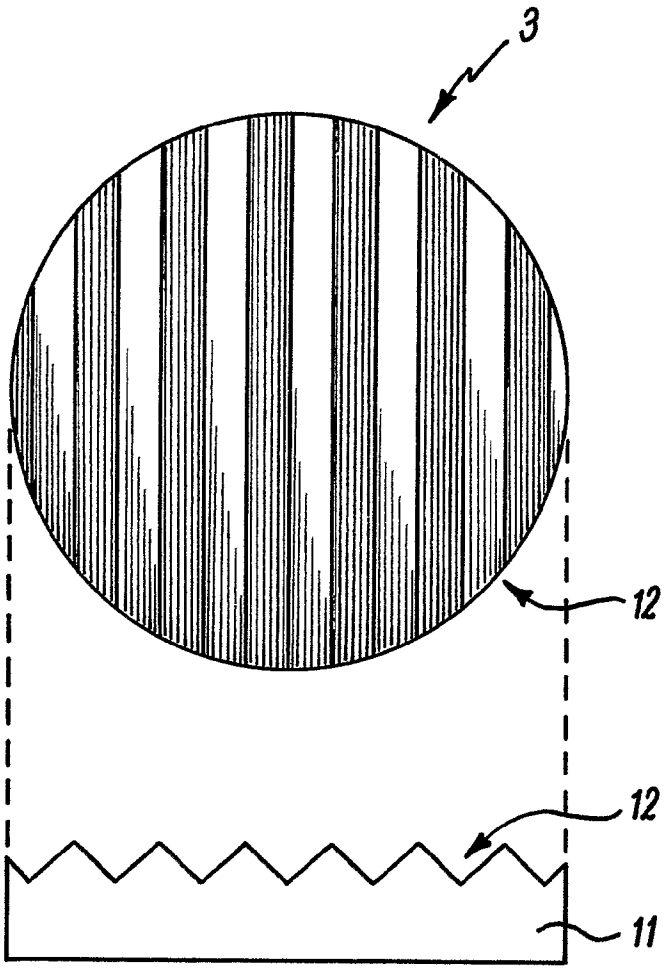
FIG. 5 illustrates schematically an abrasive disk in accordance with yet another aspect of the present invention.

FIG. 5 shows an abrasive disk, comprising a circular disk 11 of hard material and a series of sharp ridges 12. These sharp ridges 12 provide the abrasive surface that will impressed into the casing 1.

By choosing a material for the circular disk 11 that is harder than the liner 2, the disk should not be deformed by the liner 2 as it deforms. This will maximise the transfer of radial force into displacement of the circular disk 11.

By using a series of sharp ridges, the potential for slippage is low, as the extreme points of impression extend forming a barrier to slippage.

Figure 6:
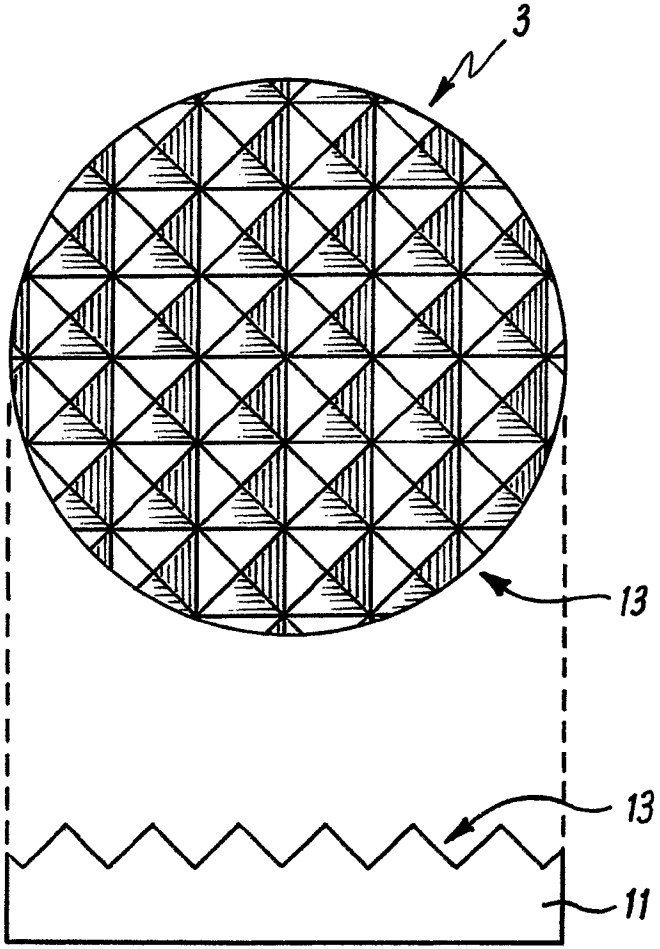
FIG. 6 illustrates schematically an abrasive disk in accordance with an alternative aspect of the present invention.

FIG. 6 shows an alternative abrasive disk, comprising a circular disk 11 of hard material, and a plurality of uniformly distributed teeth 13. These teeth provide the abrasive surface that will impress into the casing.

Using teeth ensures that there are many discrete locations at which the disk is able to make an impression into the casing. Although the grip may not be as high as that afforded by using ridges, the likelihood of forming an impression is higher.

The disks of FIGS. 5 and 6 are demonstrative of two kinds of disk that can be used in the liner 2 demonstrated in FIGS. 1 to 3.

Figure 7:
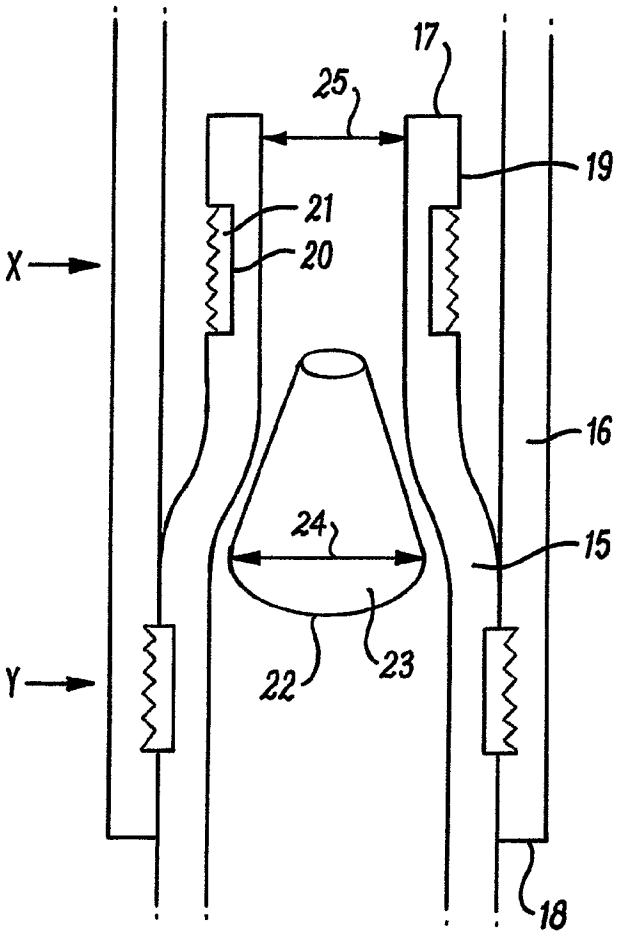
FIG. 7 illustrates schematically an expander within a liner during a hanging procedure within a casing.

FIG. 7 shows an alternative embodiment of the present invention, in which a liner 15 is located within a casing 16. The liner 15 has an upper end 17, and the casing 16 a lower end 18. The liner 15 is located within the casing 16 such that there is a significant overlap region between the liner 15 and the casing 16.

Within this overlap region, machined into the outer surface 19 of the liner 15, are a number of circular recesses 20. Located within each of these recesses 20 is an abrasive disk 21. The recesses 20 are deep enough that the abrasive disks 21 sit flush with the outer surface 19 of the liner 15, as indicated at Position X.

Additionally there is an expander 22, which takes the form of a conical frustum 23, pointing upwards. The expander 22 has a base diameter 24 larger than the initial inner diameter 25 of the liner 15. When the expander 22 is moved upwards through the liner 15, the larger base diameter 24 of the expander 22 forces expansion of the inner diameter 25 of the liner, bringing the abrasive disks 21 into frictional adherence with the casing 16. This is indicated by position Y. Position X indicates the initial condition of the liner 15 and abrasive disks 21 before expansion of the liner 15 by the expander 22.

Figure 8:
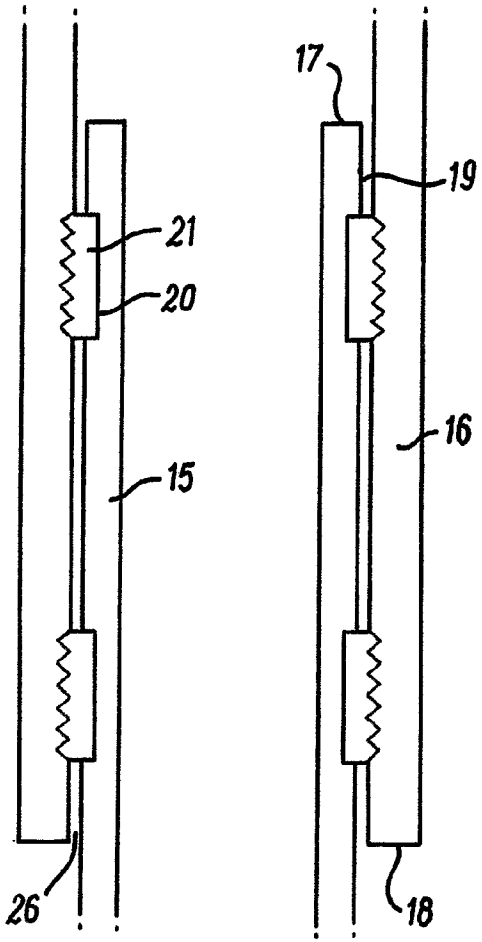
FIG. 8 illustrates schematically a liner that has been hung within a casing.

FIG. 8 shows the condition of the liner 15 after the expander 22 has passed completely through the liner 15. The abrasive disks 21 have been impressed into the casing 16 and are supporting the hanging load of the liner 15. FIG. 8 demonstrates how the hanging method leaves an annular space 26 between the liner 15 and the casing 16 through which liquids or small solids would be able to flow.

Figure 9:
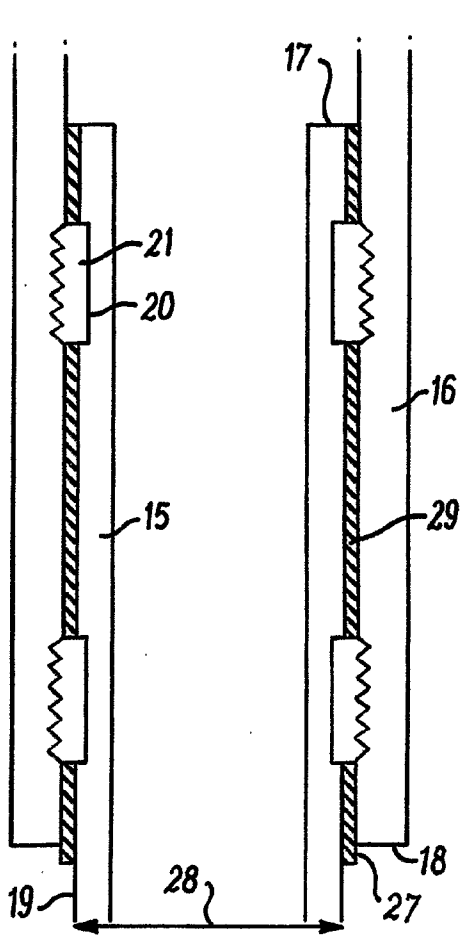
FIG. 9 illustrates schematically a liner that has been hung within a casing, with a seal therebetween.

The outer surface 19 of the liner 15 can be coated with a rubber material 27 and the outer diameter 28 of the liner 15 chosen such that the liner 15, when expanded, forms a seal 29 between the liner 15 and the casing 16. This is demonstrated by FIG. 9. The seal 29 formed by the rubber material 27 will prevent unwanted flow paths being established between the liner 15 and the casing 16.

Figure 10C:
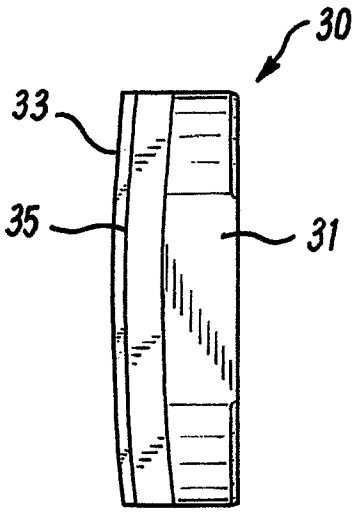
FIGS. 10A to 10C illustrate schematically an abrasive portion in accordance with an alternative embodiment of the invention.
Figure 10A:
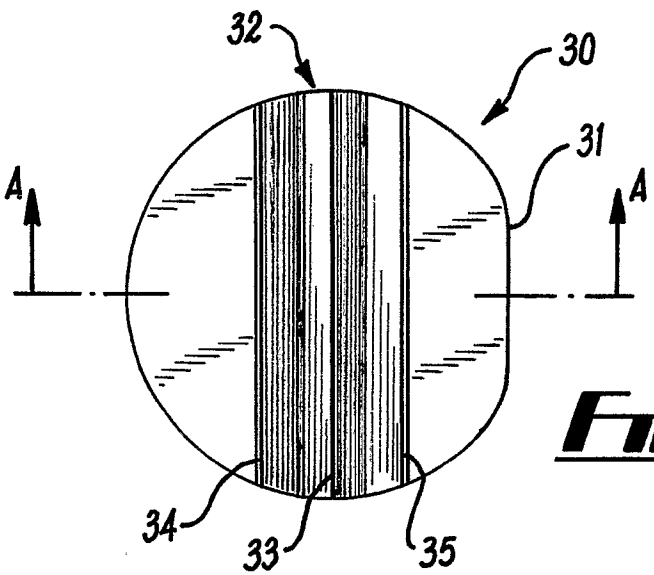
Figure 10B:
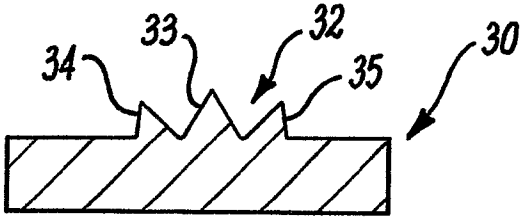

FIGS. 10A to 10C illustrate schematically an abrasive disk, generally depicted at 30, in accordance with an alternative embodiment of the invention. FIG. 10A shows the disk in plan view, and FIG. 10B shows the cross section of the disk 30 through the line A-A.

The disk 30 is substantially circular, but has a flattened edge 31. This flattened edge 31 corresponds to the shape of the corresponding recess in the liner, and prevents the disk from being positioned in an incorrect orientation with respect to the liner. The disk is made of relatively hard material, in accordance with the previously described embodiments.

As most clearly shown in FIG. 10B, the disk includes a series of sharp ridges 32. In this example, three ridges are provided and include a central ridge 33, an upper ridge 34 and a lower ridge 35. The central ridge 33 is raised higher relative to the disk surface compared with the upper and lower ridges 34, 35.

The upper and lower ridges 34, 35 are shaped asymmetrically to are profiled such that the angle of inclination from the disk surface is steeper for the outer surfaces of the ridges than the angle of inclination of the inner surfaces of the ridges. This provides directionality to the upper and lower ridges as described in more detail below.

FIG. 10C is a side elevation of the disk 30. In this example, the profile of the disk surface and the ridges is slightly convex, such that the height of the ridges relative to the disk base is greater along the central line A-A.

Figure 11:
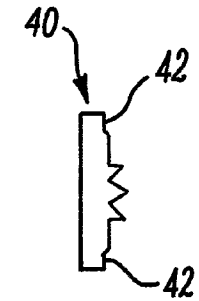
FIGS. 11 and 12 illustrate schematically abrasive portions in accordance with further alternative embodiments of the invention.
Figure 12:
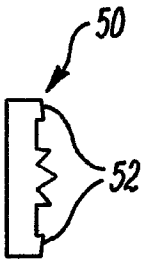

FIGS. 11 and 12 show disks according to alternative embodiments of the invention. In these examples, the disks are similar to the shown in FIG. 10A to 10C, but differ in that they are provided with a surface profile that affects the degree of pivoting in use. In the example of FIG. 11, the disk 40 is provided with upper and lower segments 42 of reduced height relative to the base of the disk. This provides clearance when the disk 40 pivots around the central ridge.

In an alternative embodiment, shown in FIG. 12 as disk 50, upper and lower segments 52 of increased height relative to the base of the disk are provided to restrict the pivoting of the disk about the central ridge. These segments 52 of increased height may be formed of the same hardened material of the disk itself, or alternatively may be pads formed from a different material of reduced or increased hardness.

Figure 13C:
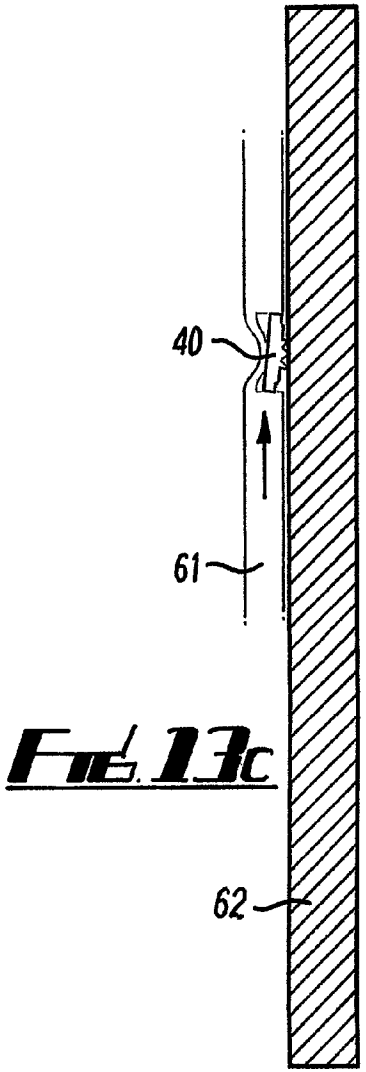
FIGS. 13A to 13C illustrate schematically a tubular connection in accordance with an embodiment of the invention, incorporating the abrasive disk of FIG. 12.
Figure 13B:
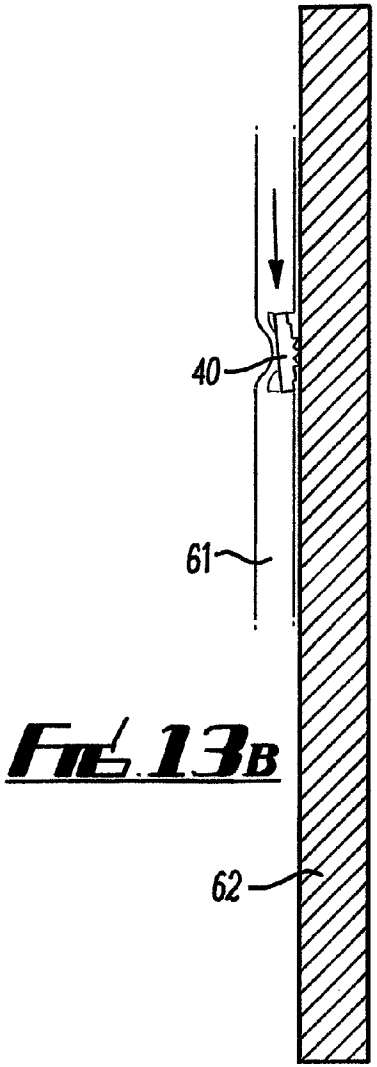
Figure 13A:
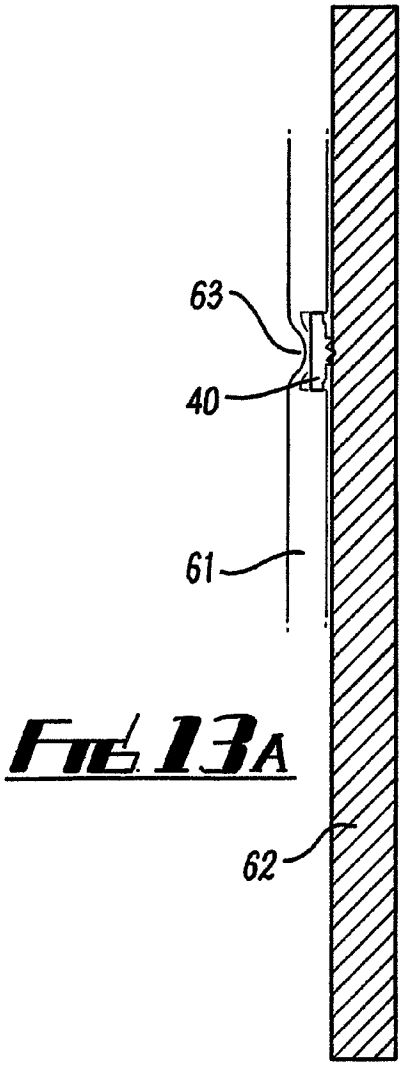

FIGS. 13A to 13C show schematically the disk of FIG. 11 in use in hanging a liner 61 from casing 62. FIG. 13A shows schematically the position of the disk 40 after dimple forming. The dimple 63 forces the disk 40 into engagement with the outer tubular in the manner described with reference to the embodiments of FIGS. 1 to 9. The ridges of the disk impress into the casing 62 as before. The raised height of the central ridge relative to the upper and lower ridges causes a greater indentation of the central ridge into the casing, by virtue of the same setting load being applied over a smaller contact area.

FIG. 13B shows the arrangement of FIG. 13A where a downward load is applied to the liner 61. The relative difference in the ridge heights causes the disk 40 to tilt, causing the lower ridge to come into contact with the casing and provide a force in an opposing, upward direction.

FIG. 13C shows the arrangement of the FIG. 13A having an upward force applied to the liner. The reversal of the load from a downward to an upward direction causes the disk to pivot over the centre ridge, allowing the upper tooth to bite into the casing and provide a force in the opposing, downward direction.

The upper and lower ridges are shaped to provide bite in an upward or lower direction. The design of the disk is bi-directional in that it provides forces opposing compressive or tensile forces applied to one or other of the tubulars.

In an alternative arrangement, the disk comprises a plurality of teeth, a subset of which extend to a height above the remainder of the teeth. The subset of teeth at extended height function as the pivot in the same manner as the central ridge of the embodiments of FIGS. 10 to 13.

The foregoing description relates to a method and apparatus for hanging a liner on a casing set into a wellbore. Although the techniques described are particularly suited to this application, the invention is not limited to such. For example, the techniques described are applicable to the hanging of a liner in a dedicated pipe or joint run in with the casing, or indeed in other downhole tubulars.

In addition, the techniques are applicable to the hanging of apparatus other than liners in downhole tubulars. For example, it may be necessary to hang packers, plugs, bridge plugs, sandscreens, scab liners or other apparatus in downhole tubulars. The arrangements of abrasive portions and the dimple forming or expanding techniques of the invention could be adapted for use in these applications.

A number of advantages can be had over the state of the art with regard to a number of features of the apparatus of the invention. In the first instance, using abrasive disks vastly improves the frictional adhesion of the apparatus to the existing casing.

A further advantage of aspects of the present invention is that scatter dimpling maintains the tensile strength of the pipe. This is because any deformation is kept to a local level, minimising unnecessary damage.

The advantage of using toothed disks in machined recesses is that less load is required to push the teeth into the casing by a fixed displacement than to deform an entire thickness of the tubular member into the existing casing. This offers the additional advantage that as the load is not too high the actuation tool is less likely to jam.

A further advantage of the present invention is that the hanging can be achieved without it being necessary to modify the existing casing or casing the wellbore with a specifically designed tubular.

Furthermore, techniques like nitride hardening, which is one of the best available hardening methods, can be used for discrete abrasive portions to increase the local hardness. Otherwise this technique could not realistically be used as if the whole circumference was hardened in this way then upon expansion the tubular member would shatter.

The principal advantage of the present invention is that it provides anchoring of apparatus to an existing downhole tubular with sufficient strength to sustain a substantial hanging load while maintaining the tensile strength of the apparatus and downhole tubular. Furthermore, it will be of particular benefit to anchoring expandable tubulars whereby the use of abrasive portions will increase the hanging load that can be supported.

Further modifications and improvements may be added without departing from the scope of the invention herein described. For example the reverse process may be carried out whereby abrasive portions for gripping surfaces are dimpled or deformed inwards from the casing to the self contained liner. Furthermore, the expander might take an alternative form, for example a ball or a dart.

The invention claimed is:

1. An apparatus adapted to be hung in a downhole tubular using one or more dimple formers, the apparatus comprising a tubular member of a circular cross-section having an outer surface and an inner surface wherein the outer surface includes one or more circumferentially distributed abrasive inserts to the tubular member, the said one or more abrasive inserts located in one or more recesses on the outer surface of the circular cross-section of the tubular member, the abrasive inserts being arranged to be movable radially outwards and with respect to the outer surface of the tubular member by the dimple formers, to bring said abrasive inserts into frictional contact with a downhole tubular.

2. The apparatus as claimed in claim 1 wherein the material of the one or more abrasive inserts is harder than the material of the tubular member.

3. The apparatus as claimed in claim 1 wherein the one or more abrasive inserts are disks, each disk comprising an abrasive surface.

4. The apparatus as claimed in claim 1 wherein the one or more recesses are machined.

5. The apparatus as claimed in claim 3 wherein the recesses are sized such that the disks are flush with the outer diameter of the tubular member.

6. The apparatus as claimed in claim 3 wherein the recesses are sized such that the disks are beneath the outer diameter of the tubular member.

7. The apparatus as claimed in claim 1 wherein the one or more recesses have a base which is spherical in relief:

8. The apparatus as claimed in claim 3 wherein each abrasive surface is a machined surface of the disk.

9. The apparatus as claimed in claim 3 wherein each abrasive surface comprises one or more formations extending from the surface of the disk to a first height, and one or more formations extending from the surface of the disk to a second height, greater than the first height.

10. The apparatus as claimed in claim 9 wherein one or more formations extending to the second height provides a pivot about which the disk is able to tilt on application of a force in an axial direction of the tubular member.

11. The apparatus as claimed in claim 9 wherein one or more formations extending to the first height are shaped to provide a force on the tubular member having a component in an axial direction of the tubular member.

12. The apparatus as claimed in claim 9 wherein the one or more formations extending from the surface of the disc to the first height and the one or more formations extending from the surface of the disc to the second height comprise a series of ridges.

13. The apparatus as claimed in claims 9 wherein the formations comprise a plurality of teeth.

14. The apparatus as claimed in claims 3 wherein each abrasive surface is knurled.

15. The apparatus as claimed in claim 14 wherein the knurled surface is hardened.

16. The apparatus as claimed in claim 1 wherein a plurality of abrasive inserts is provided, the abrasive inserts being distributed equidistantly around the tool.

17. The apparatus as claimed in claim 1 wherein the one or more abrasive inserts comprise hardened steel.

18. The apparatus as claimed in claim 1 wherein the apparatus is a liner.

19. The apparatus as claimed in claim 1 wherein the downhole tubular is casing.

20. A liner, for hanging in a casing using one or more dimple formers, the liner comprising a tubular member of a circular cross-section with a hollow bore therethrough, having an outer surface and an inner surface wherein the outer surface includes one or more circumferentially distributed abrasive inserts to the tubular member, the said one or more abrasive inserts located in one or more recesses on the outer surface of the circular cross-section of the tubular member, wherein the said one or more abrasive inserts are arranged to be movable radially outwards and with respect to the outer surface of the tubular member by the dimple formers to bring said abrasive portions into frictional contact with the casing into which the liner has been inserted.

21. A method of hanging an apparatus in a downhole tubular, the method comprising the steps of:

(a) running the apparatus into the downhole tubular, the apparatus comprising a tubular member of circular cross-section having an outer surface and an inner surface, wherein the outer surface comprises one or more circumferentially distributed abrasive inserts located in one or more recesses on the outer surface of the circular cross-section of the tubular member;

(b) upon reaching a desired position in the tubular, locating one or more dimple formers on the inner surface of the tubular member corresponding to the locations of the one or more abrasive inserts on the outer surface; and (c) moving the abrasive inserts radially outwards and with respect to the outer surface of the tubular member by moving the dimple formers to contact on the inner surface of the tubular member, such that the abrasive inserts are moved into frictional adherence with the downhole tubular.

22. The method as claimed in claim 21 comprising the additional step of selecting the apparatus to have an outer diameter such as to form an interference fit with the downhole tubular.

23. The method as claimed in claim 21 comprising the step of using dimple formers located on a running tool which runs the apparatus into the downhole tubular.

24. The method as claimed in claim 21 comprising the step of using dimple formers on a separate tubular tool run into the apparatus, once the apparatus is positioned in the downhole tubular.

25. The method as claimed in claim 21 comprising the additional step of moving the abrasive inserts by the distance required to impress the abrasive portions into frictional adherence with the downhole tubular.

26. The method as claimed in claim 21 comprising the step of selecting a downhole tubular that has an inner diameter machined or manufactured to a high tolerance.

27. The method as claimed in claim 21 comprising the step of selecting apparatus that is machined or manufactured to form a close clearance fit within the downhole tubular.

28. The method as claimed in claim 21 wherein the downhole tubular is casing.

29. The method as claimed in claim 21 wherein the downhole tubular is a pipe or a dedicated joint which has been deployed within a previously set tubular.

* * * * *